343-700 MS AU 256 EX
12/13/77 OR 4,063,245

United States Patent [19]
James et al.
[11] 4,063,245
[45] Dec. 13, 1977

[54] MICROSTRIP ANTENNA ARRAYS

[75] Inventors: James Roderick James; Geoffrey John Wilson, both of Swindon, England

[73] Assignee: The Secretary of State for Defence in Her Britannic Majesty's Government of the United Kingdom of Great Britain and Northern Ireland, London, England

[21] Appl. No.: 658,000

[22] Filed: Feb. 13, 1976

[30] Foreign Application Priority Data
Feb. 17, 1975 United Kingdom ..... 6691/75

[51] Int. Cl.² ..... H01Q 1/38
[52] U.S. Cl. ..... 343/700 MS; 343/846
[58] Field of Search ..... 343/846, 700 MS, 854

[56] References Cited
U.S. PATENT DOCUMENTS

| | | | |
|---|---|---|---|
| 3,643,262 | 2/1972 | Dumanchin | 343/700 MS |
| 3,803,623 | 4/1974 | Charlot | 343/700 MS |
| 3,811,128 | 5/1974 | Munson | 343/700 MS |
| 3,921,177 | 11/1975 | Munson | 343/700 MS |

*Primary Examiner*—Eli Lieberman
*Attorney, Agent, or Firm*—Pollock, VandeSande and Priddy

[57] ABSTRACT

A microstrip antenna array takes the form of a feeder strip and a plurality of elements, each in the form of a strip attached to the feeder strip at one end and having an open-circuit termination at the other. Arrays are disclosed which use standing waves in the feeder strip and which use travelling waves. The elements can be of various widths to provide a modulated array and, in the case of a travelling wave array, to compensate for attenuation in the wave in the feeder strip. A frequency-swept array and a circularly polarized array are described.

7 Claims, 12 Drawing Figures

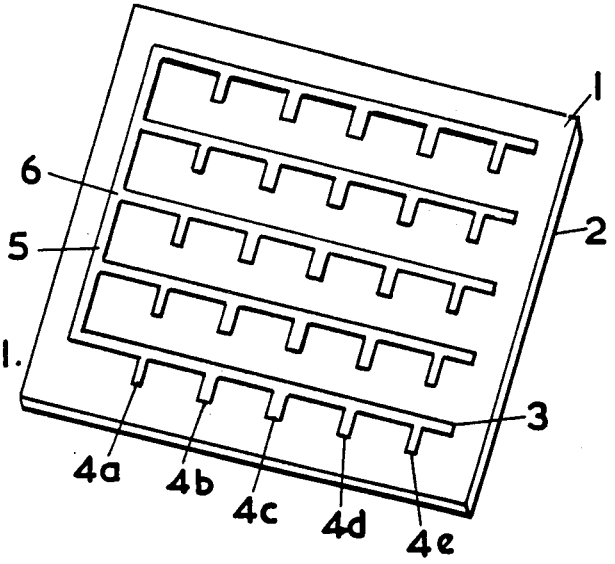
FIG.1.
FIG. 2.
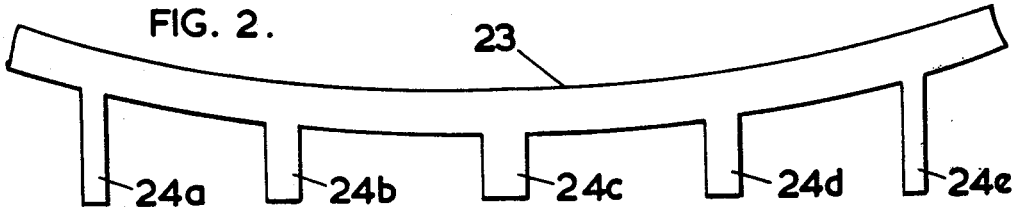
FIG. 3.
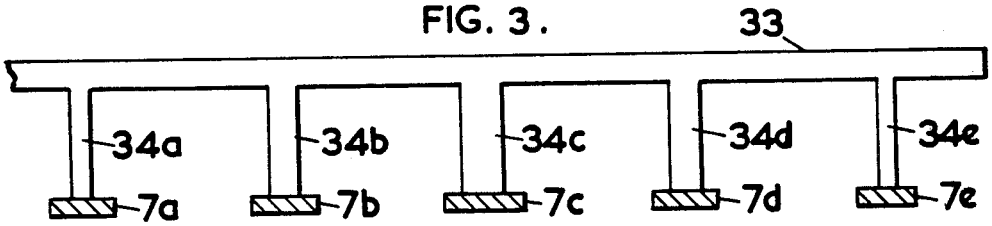
FIG. 4.
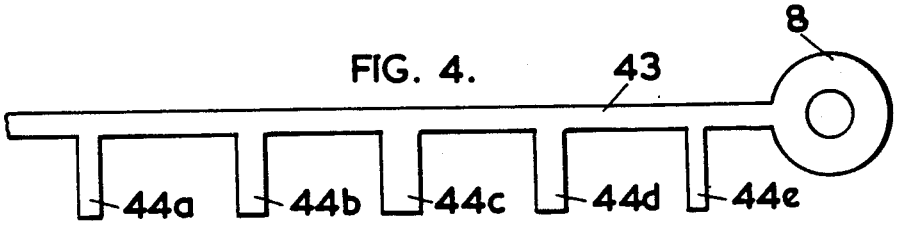

MICROSTRIP ANTENNA ARRAYS

The present invention relates to microstrip antennae and more particularly to microstrip antenna arrays.

A microstrip component consists of a pattern of conducting material on an insulating substrate with a conducting backing. The conducting material is typically copper and a number of suitable substrate materials are known. Microstrip components such as filters and couplers are known particularly for use in connection with microwave circuits.

Microstrip antenna arrays are also known comprising a feeder strip and a plurality of radiating elements each consisting of a short strip parallel to and closely separated from the feeder strip. The intention of such arrays is that each of the elements will radiate like an electric dipole, by analogy with a wire or rod aerial such as a conventional television aerial. The relative strengths of the radiation from the various elements is modified by varying the spacing between the elements and the feeder strip. The performance of such arrays is however difficult to a useful degree of accuracy and it is therefore difficult to design arrays with desired characteristics.

It is an object of the present invention to provide a form of microstrip antenna array with comparatively readily predictable performance.

A microstrip antenna array according to the present invention comprises a pattern of conducting material on an insulating substrate with a conducting backing, wherein the pattern includes a feeder strip and a plurality of elements each comprising a strip connected at one end to an extending away from the feeder strip, the other end being an open-circuit termination The elements may all be substantially at right angles to and all on the same side of the feeder strip.

The elements may be an integral number of half wavelengths long at some operating frequency. In an array in which the feeder strip is adapted to support standing waves the elements are preferably connected to the feeder strip at current nodes.

The elements may include elements of differing widths.

A plurality of arrays may be combined to form a two-dimentional array.

As a result of some investigations carried out by the present inventors it has been found that radiation from a microstrip with an open-circuit termination mainly emanates from the termination, which radiates approximately like a magnetic dipole source, and that the power radiated from the termination, provided the excitation is maintained at a constant level, and provided that the width of the strip is neither too large or too small, is approximately proportional to the square of the width of the strip. In the present invention therefore the elements each have only one open-circuit termination. By suitably choosing the widths of the elements it is possible to provide a modulated array in which the elements radiate at different intensities and thereby form an array with favourable directional characteristics. The same considerations apply to array for reception as to arrays for transmission and the present invention is applicable as to arrays for transmission and the present invention is applicable to both.

Since the length which an element must have in order to resonate at a given frequency depends to a small extent on the width of the element it may be desirable to curve the feeder strip so that the open-circuit ends of the elements are in a straight line.

Troughs in the substrate may be provided adjacent to the open-circuit terminations of the element to inhibit the launching of surface waves.

Some embodiments of the invention will now be described by way of example and illustration for the better understanding of the invention and the advantages to be attained therewith, with reference to the accompanying drawings, of which:

FIG. 1 is a perspective view of an antenna array according to the invention, FIGS. 2, 3 and 4 show alternative patterns of conducting material which may be used in antenna arrays of the general form shown in FIG. 1.

Figure 5:
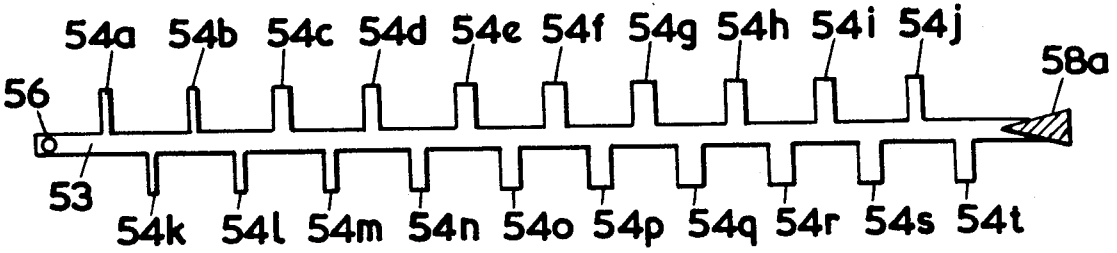
FIG. 5 shows a conductor pattern for a simple travelling-wave array according to the invention.

FIG. 1 shows an insulating substrate 1 with a conducting backing 2. On the front face of the substrate 1 is a two dimensional array consisting of five simple arrays each comprising an elongated feeder strip and five radiating antenna elements. The antenna elements are of elongated strip configuration, are dimensioned as half-wave resonators, and the antenna elements are spaced along each feeder strip one wavelength apart with the direction of elongation of each antenna element being transverse to the direction of elongation of its associated feeder strip. For example the feeder strip 3 is formed integrally with elements 4*a* to 4*e*, equispaced one wavelength apart, 4*e* being attached to the feeder strip 3 at a point half a wavelength from the end of the feeder strip 3.

The antenna elements are of differing widths, those nearer the centre of each simple array, such as 4*c*, being wider than those nearer the ends, such as 4*a* and 4*e*. In FIG. 1 all the simple arrays are shown as being identical but it would be possible to make the widths of the antenna elements vary from one simple array to another as well as from one position in a simple array to another position in the same simple array. The feeder strips 3 are attached to a strip 5 at points one wavelength apart and an input/output connection 6 is provided at the center of the strip 5.

The method of manufacture of an array such as that shown in FIG. 1 is substantially the same as that for known microstrip devices which, being known to those skilled in the microstrip art, need not be described here. The materials for the conductors and the substrate are also conventional, the only unusual requirement being that as in any other antenna array the relative positions of the elements must be maintained, so that either materials prone to buckling should not be used, or a suitable mounting should be provided to prevent buckling.

In order to obtain good directional properties in an array—that is to say good gain and low side-lobe level—it is desirable to be able to provide different elements in the array with different emission intensities.

In the illustrated embodiments the antenna elements have different widths and therefore different emission intensities, so it is possible, using the rule that the power radiated is proportional to the square of the width, which holds approximately for moderate widths, to construct, using the invention, antenna arrays whole directional properties are at least better than those of arrays of similar size whose radiating elements all radiate the same power. The design of arrays according to the invention is also simplified by the fact that the antenna elements radiate mainly from one end and can therefore be considered approximately as small magnetic dipoles, in contrast to known microstrip antenna arrays in which the elements each radiate from both ends and therefore act approximately as pairs of small dipoles.

A half-wave microstrip strip resonator is not exactly half a wavelength long; there is an end correction which means that it must be slightly shorter. This end correction is greater when the strip is wider, so a wider half-wave resonator will be shorter than a narrower one.

FIG. 2 shows a pattern of conducting material for an array according to the invention in which the elongated feeder strip 23 is curved so as to bring the open-circuit ends of the antenna elements 24*a* to 24*e* into a straight line. For purposes of exposition the amount of curvature in the feeder strip 23 and the variation in length between the antenna elements 24*a* – 24*e* are greatly exaggerated in FIG. 2.

In FIG. 3 is shown a pattern of conducting material for an array according to the invention in which troughs 7*a* to 7*e* are cut in the substrate adjacent to the open-circuit terminations of the elements 34*a* to 34*e*. The effect of these troughs is to inhibit the launching of surface waves into the substrate from the ends of the antenna elements and thereby to simplify the angular dependence of the radiation from the elements, making them more dipole-like.

In FIG. 4 is shown a pattern of conducting material for an array according to the invention comprising a feeder strip 43 and elements 44*a* to 44*e*. The feeder strip 43 is terminated by a ring resonator 8 which is dimensioned so as to act as an open-circuit termination at the operating frequency. The effect of using a ring resonator instead of an open-circuit termination is to reduce the amount of radiation from the termination which would otherwise make an unwanted contribution to the radiation pattern of the array.

For the purposes of simplicity of exposition, arrays have been illustrated having five antenna elements, and in FIG. 1 a multiple array having five simple arrays was shown. It is not intended to imply that five is an optimum number. In fact an array with nine simple arrays, each with nine elements, would be a more typical example.

Figure 5A:
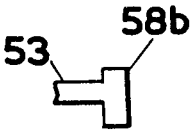
FIG. 5*a* shows an alternative form of termination for an array such as that of FIG. 5.

In FIG. 5 is shown a simple travelling-wave array. A feeder strip 53 has at one end an input/output connection 56 and at the other end a reflection-inhibiting termination 58*a* consisting of a triangular piece of lossy material such as carbon-doped fabric overlaying the end of the feeder strip 53. An alternative form of termination is shown in FIG. 5*a* as 58*b* comprising a patch resonator eccentrically attached to the end of the feeder line 53 so as to provide an impedance matched to the characteristic impedance of the feeder line. A first set of antenna elements 54*a* to 54*j* each half a wavelength long are attached to the elongated feeder strip 53 on one side thereof and extend away from it at right angles to the feeder strip. The antenna elements in the first set are spaced one wavelength apart. A second set of antenna elements 54*k* to 54*t* also half a wavelength long are attached to the feeder strip 53 on the other side thereof and extend away from it at right angles to the feeder strip. The elements in the second set are spaced one wavelength apart and are half a wavelength from adjacent elements in the first set.

The antenna elements in each set are generally wider towards the middle of the array than towards the ends, as in the arrays of FIGS. 1 to 4 and for the same reason, but they are also generally wider towards the termination 58*a* or 58*b* than towards the connection 56. This is because a wave travelling along the feeder strip will be attenuated, largely by radiation from the antenna elements, and therefore the elements nearer to the termination need to be wider to radiate the same power (or, if the array is being used for reception, to deliver the same power to the connection 56).

Figure 6:
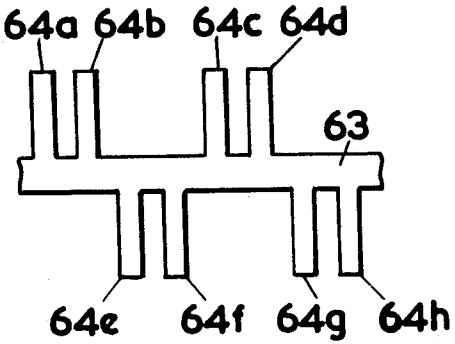

A travelling-wave array such as that shown in FIG. 5 is preferably comparatively long, 60 antenna elements for example would be typical, so that as much power as possible goes into the radiation rather than being dissipated in the termination 58*a* or 58*b*. To reduce the length of the array it is possible to replace the single antenna elements by compact groups of elements thus fitting more antenna elements in and thus radiating more power. This is illustrated in FIG. 6 where the single elements of FIG. 5 are replaced by pairs of antenna elements spaced about a quarter of a wavelength apart. This arrangement degrades the directional properties somewhat but it allows advantage to be taken in a shorter array of the superior frequency characteristics as determined for example by the voltage standing-wave ratio of the travelling-wave array compared with the standing-wave array.

Figure 7:
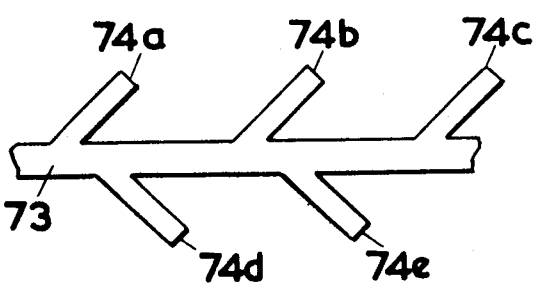
FIGS. 6 to 8 illustrate alternative patterns of conductors for an array such as that of FIG. 5, and FIGS. 9*a*, 9*b* and 9*c* constitute a set of diagrams illustrating the principle of the invention.

The arrays so far described radiate or receive plane-polarized waves. An array adapted for use with circularly polarized waves is illustrated in FIG. 7. The array is generally of the form shown in FIG. 5 but the antenna elements 74*a* to *e* are inclined at forty-five degrees to the direction of elongation of feeder strip 73, and the antenna elements of the second set 74*d* and *e* are attached to the feeder strip 73 at points a quarter of a wavelength from adjacent antenna elements 74*a* and *b* respectively of the first set. Since the antenna elements in the second set are at right angles to those of the first set they radiate (or receive) orthogonally polarized radiation. Since they are displaced by a quarter of a wavelength there is a quarter of a cycle phase difference so the array radiates (or receives) circularly polarized radiation.

Figure 8:
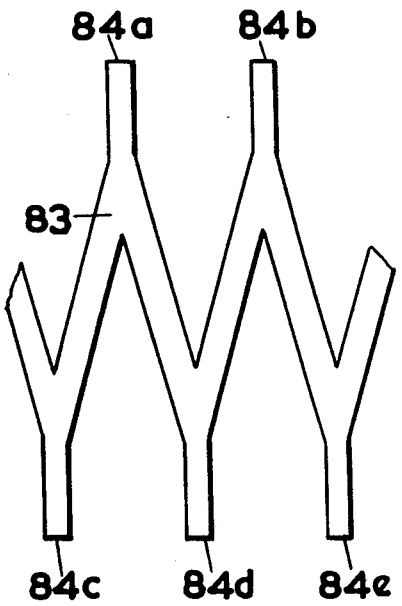

If, in a travelling-wave array such as that illustrated in FIG. 5, the frequency is shifted slightly from the designed operating frequency the elements will no longer radiate in phase. Instead there will be a progressive phase difference from one end of the array to the other. This has the effect of moving the main beam direction of the array. An array adapted to utilize this effect to steer its beam is known as a frequency-swept array. FIG. 8 illustrates part of a frequency-swept array of the general form of FIG. 5 but with the elongated feeder strip 83 having a zig-zag form and with the antenna elements of the first and second set extending outwardly of the feeder strip from alternate bends of the zig-zag. Adjacent elements 84*a* and *b* are spaced three wavelengths apart on the feeder strip and the antenna elements 84*c* to *e* of the second set are attached to the feeder strip one and a half wavelengths from adjacent antenna elements of the first set. Because of the bent form of the feeder strip 83 the distance in space between adjacent antenna elements of the first set and similarly the distance between adjacent antenna elements of the second set, is proportionately reduced. This enhances the beam steering effect.

Figure 9:
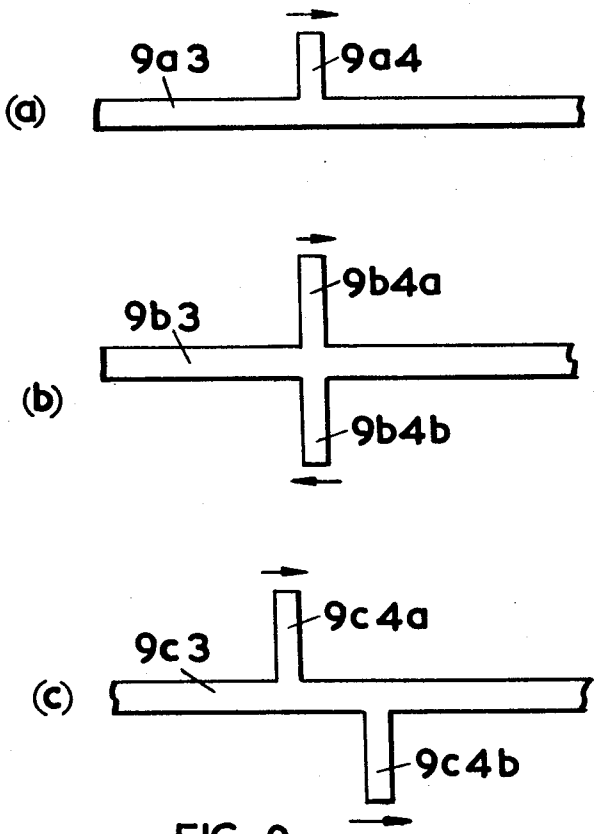

The present inventors have found that a microstrip antenna element with an open-circuit termination and carrying electromagnetic waves radiates mainly from the termination and that the radiation pattern from the termination is to a useful approximation that of an oscillating magnetic dipole. FIG. 9a illustrates a microstrip stub 9a 4 attached to a feeder strip 9a 3. The orientation of the equivalent magnetic dipole is shown by an arrow. It lies in the plane of the microstrip pattern and across the end of the stub 9a 4. In FIG. 9b two identical stubs 9b 4a and 9b 4b are attached to a feeder strip 9b 3 at the same point but extend from the feeder strip in opposite directions. Since the two stubs are attached at the same point on the feeder strip they must be excited in phase, but since they extend in opposite directions from the feeder strip the equivalent magnetic dipoles, whose directions are shown by arrows, are oriented in opposite directions. In the direction normal to the microstrip pattern the radiations from the two stubs are therefore out of phase. In FIG. 9c two identical stubs 9c 4a and 9c 4b are attached to a feeder strip 9c 3 and extend in opposite directions therefrom but now they are attached to the feeder strip at points half a wavelength apart so they are excited out of phase. The combined effect of being excited out of phase and of extending in opposite directions is that the equivalent dipoles, whose directions are shown by arrows, are oriented in the same direction so that the radiations are in phase normal to the microstrip pattern.

The described embodiments are not intended to form an exhaustive catalogue of possible configurations of antenna and feeder strips. Although it has sometimes been convenient to direct the description particularly towards arrays for transmission, persons skilled in the antenna art will know very well that similar considerations apply to arrays for reception, and the present invention applies to both. The invention could be applied to millimeter waves by using microstrip techniques on a quartz substrate.

We claim:

1. A microstrip antenna array comprising a pattern of conducting material on an insulating substrate with a conducting backing wherein said pattern includes an elongated feeder strip and a plurality of elongated radiating antenna elements disposed in spaced relation to one another along at least one edge of said feeder strip, the direction of elongation of each of said antenna elements being transverse to the direction of elongation of said feeder strip, each of said antenna elements consisting of an elongated strip connected at one of its ends to and extending away from said feeder strip, the other end thereof being an opencircuit termination, said elongated radiating antenna elements being of various different widths respectively so as to provide the array with modified directional characteristics, and said antenna elements being approximately an integral number of half wavelengths long relative to electromagnetic waves in said antenna elements at a predetermined operating frequency.

2. An array as claimed in claim 1 wherein said feeder strip is adapted to support standing electromagnetic waves at a predetermined operating frequency, said antenna elements being respectively attached to said feeder strip at points corresponding to current nodes in said standing waves.

3. An array as claimed in claim 1 wherein said feeder strip is adapted to support electromagnetic waves travelling predominantly in one sense.

4. An array as claimed in claim 3 wherein said elongated radiating antenna elements are disposed in a first set of antenna elements extending from one edge of said elongated feeder strip and attached to said feeder strip at positions such that all the antenna elements of said first set are in phase with one another relative to electromagnetic waves in said feeder strip at said operating frequency, and a second set of said elongated radiating antenna elements extending from the other edge of said feeder strip in the opposite direction from the elements of said first set and attached to said feeder strip at positions such that the antenna elements in said second set are in phase with one another but half a cycle out of phase with the antenna elements of said first set relative to electromagnetic waves in said feeder strip at said operating frequency.

5. An array as claimed in claim 3 wherein said elongated radiating antenna elements are disposed in a first set of compact and separate groups of said elements extending from one side of said feeder strip and attached to said feeder strip at positions such that corresponding antenna elements in all of the groups of said first set are in phase with one another relative to electromagnetic waves in the feeder strip at the operating frequency, and a second set of similar groups of said elongated radiating antenna elements extending from the other side of said feeder strip in the opposite direction from the elements of the groups of said first set and attached to the feeder strip at positions such that corresponding antenna elements in all of the groups of said second set are in phase with one another but half a cycle out of phase with corresponding antenna elements in the group of said first set, relative to electromagnetic waves in said feeder strip at said operating frequency.

6. An array as claimed in claim 3 wherein said elongated radiating antenna elements are disposed in a first set of said elements which extend obliquely relative to the direction of elongation of said feeder strip from one side of said feeder strip and which are attached to said feeder strip at positions such that all the elements of the first set are in phase with one another relative to electromagnetic waves in said feeder strip at said operating frequency, and a second set of said elongated radiating antenna elements extending from the feeder strip at right angles to the antenna elements of said first set and attached to said feeder strip at positions such that the antenna elements in said second set are in phase with one another but in quadrature with the antenna elements of said first set relative to electromagnetic waves in said feeder strip at said operating frequency.

7. An array as claimed in claim 4 wherein said elongated feeder strip is in bent form such as to reduce proportionately the distance between adjacent antenna elements in said first set and also the distance between adjacent antenna elements in said second set.

* * * * *